US006825778B2

(12) United States Patent
Bergan et al.

(10) Patent No.: US 6,825,778 B2
(45) Date of Patent: Nov. 30, 2004

(54) VARIABLE SPEED LIMIT SYSTEM

(75) Inventors: Terry Bergan, Grasswood (CA); Robert Bushman, Hepburn (CA)

(73) Assignee: International Road Dynamics Inc., Saskatoon (CA)

( * ) Notice: Subject to any disclaimer, the term of this patent is extended or adjusted under 35 U.S.C. 154(b) by 0 days.

(21) Appl. No.: 10/274,042

(22) Filed: Oct. 21, 2002

(65) Prior Publication Data

US 2004/0075582 A1 Apr. 22, 2004

(51) Int. Cl.[7] ..... G08B 1/01
(52) U.S. Cl. ..... 340/936; 340/933
(58) Field of Search ..... 340/905, 903, 340/901, 936, 438, 441

(56) References Cited

U.S. PATENT DOCUMENTS 5,917,430 A * 6/1999 Greneker et al. ..... 340/905
6,097,313 A * 8/2000 Takahashi et al. ..... 340/905
6,150,961 A * 11/2000 Alewine et al. ..... 340/995.1
6,166,658 A * 12/2000 Testa ..... 701/93
6,606,033 B1 * 8/2003 Crocker et al. ..... 340/901

* cited by examiner

*Primary Examiner*—Jeffery Hofsass
(74) *Attorney, Agent, or Firm*—Borden Ladner Gervais LLP; L. Anne Kinsman

(57) ABSTRACT

A variable speed limit work zone safety system is provided herein. It includes at least two spaced-apart stations. Each station includes a plurality of sensors to gather information relative to at least one of traffic flow and road conditions. The station includes a controller which is programmed to analyse data which is received from the sensors and to derive, therefrom, an optimum speed limit at a selected location adjacent to, or in, the work zone. The station further includes a communication sub-system to communicate data related to the optimum speed limit to a message board to display the optimum speed to motorists.

25 Claims, 3 Drawing Sheets

VARIABLE SPEED LIMIT SYSTEM

FIELD OF THE INVENTION

The present invention relates to a traffic control system and more particularly to a system that can automatically determine appropriate speed limits at various locations.

BACKGROUND OF THE INVENTION

It is well known that many people are injured annually as a result of motor vehicle crashes in construction work zones, and many of those injuries result in fatalities. Drivers not paying attention and excessive speed are the leading factors in these accidents, over 40% of which happened in the transition area before the construction work zone. The transition from high speed, open road traffic to reduced speeds at points of traffic congestion and construction sites, etc., can result in rapid deceleration or rear end accidents, and uneven traffic flow, while reducing capacity and possibly enabling unsafe speeds in construction work zones.

The prior art has attempted to solve this problem by the use of portable light signalling equipment. Such portable light signalling equipment has been used for both regulating traffic at restricted points and as a replacement for defective stationary equipment. Frequently, it is observed that movable traffic lights of this kind, which are required at building sites, for example, are not optimally adapted to the traffic flow, and as a result cause unnecessary delays to much of the traffic, particularly when the traffic flow is fluctuating. Generally, conventional portable light signalling equipment includes equipment that does not have any optional feedback system. The "stop", "go" and clearance times are preprogrammed and are usually only very broadly adapted to the actual traffic, and are invariant in their daily operation. Centrally controlled and monitored equipment, with passive light signalling equipment, allows the signal to be set by feedback. However, such equipment requires expensive cabling, the size of which has to be adapted to the power (including the current supply to the lights) to be transmitted. For example, U.S. Pat. No. 6,124,807, issued Sep. 26, 2000, to R. Heckcroth et al, provides a procedure for regulating traffic by means of movable light signalling equipment. The movable signals are placed at restricted areas, and use sensor controls to prescribed "go" times and clearance times in the area to be secured (i.e., along a blocked stretch). The transit time of vehicles, over a measured distance extending substantially along the blocked stretch, is measured and the clearance time is established as a function of the transit time measurements obtained.

It is also known to use an apparatus for controlling two traffic lights at either end of a work zone. Axle counters are provided that switch the apparatus over by means of counters whenever there is a coincidence between two counting circuits (i.e., when the number of the counted vehicles leaving the restricted area equals the number of the vehicles that entered the area). However, there can be malfunctions if vehicles remain in the restricted area, or enter the restricted area outside of the surveillance points. In such cases, the equipment has to be restarted. Moreover, such equipment does not provide separate "go" and clearance times. For example, U.S. Pat. No. 5,900,826, issued May 4, 1996 to Farber, discloses a signalling system for controlling two-way traffic flow around a construction zone. The system consists of two traffic lights at opposite ends of a construction zone that are alternately activated to give a green light to oncoming traffic. The lights communicate through a wireless link. The lights are also provided with sensors that detect whether a vehicle is attempting to go through on a red light. When such a vehicle is detected, an audible warning signal is activated.

In another prior art system, traffic signals and detectors, e.g., pressure sensors at both ends of a restricted section, are provided for detection of the number of vehicles passing through. The signalling time of green signals is extended at the heavier traffic end. A signal controller circuit includes a signal device that changes the signal indication by means of vehicle detector, e.g., light sensors or the like, provided adjacent to the signals. Further, a system is known for an alternately switched traffic signal controller having a set of traffic signals which are operated such that while one traffic light at the "passage allowed" end is green, the other traffic signal at the "no passage allowed" end is red, or against. Detectors are provided for detection of vehicles passing through the section. Furthermore, a traffic signal device is also provided at both ends of a road section under construction. In such systems, the waiting time is still comparatively long, thus easily causing traffic jams when traffic density is distinctly larger at one side than at the other side in the road repairing section.

In addition, sensitive systems have been employed for control of the lighting of the traffic signals based on the detection of vehicles by the detector, e.g., pressure sensors, light sensors or the like. The control systems for traffic signals can be damaged in case of troubles in the detector means. Furthermore, as such signal systems are usually still in operation even at night when no vehicles are present, there is sometimes no input of detection signals for more than a pre-set time. In such a case, it cannot be concluded merely from the fact of no traffic that the detector means are out of order. Additionally, vehicles from the opposite directions can be exposed to great danger of head-on collision in the case that a vehicle enters the section against a red signal immediately after the change to red from green, while another vehicle also enters the section because of the signal change to green from red before the passing of the opposite vehicle.

Portable traffic control systems that are particularly suited to controlling traffic in work areas have also been disclosed. Normally, the systems are used on roads that have two traffic lanes, each for traffic in a different direction. When repair work is being performed on one lane of the road, however, the traffic in both directions must use the other lane. The control systems employ traffic lights at each end of the traffic lane, alternately presenting a "go" signal first to traffic from one direction and then to traffic from the other direction. The signals are viewable not only by oncoming traffic but also by an operator standing between the display units.

Another known device is intended to alert work zone personnel when a vehicle enters the work zone. This device is configured to detect the intrusion of a vehicle into the work zone along any section of the work zone perimeter adjacent to an active traffic lane. An infrared source is placed at the beginning of the work zone, which transmits a continuous wave infrared signal along the perimeter of the work zone for reception by an infrared detector positioned downstream. If a vehicle passes between the source and the detector, thereby interrupting the continuous wave infrared signal which is transmitted therebetween, the detector acknowledges this obstruction by sounding an alarm. However, this device also suffered numerous problems in operation.

This device suffers from several integrity problems. The heat and audible noise produced by work zone equipment, passing traffic, and other conditions of the work zone environment is capable of interfering with the infrared or ultrasonic detectors in such a way that the detectors can fail to detect a vehicle passing through the detection beam. Because the detector is designed to sense the presence or absence of a reflected detection beam, the detector is susceptible to detecting the heat or noise produced in the work zone as the reflected detection beam, even when the detection beam is obstructed by a vehicle entering the work zone. This is particularly true where the detector employs a continuous infrared signal. Thus, the potential always exists for a vehicle to pass through the detection beam without sounding the alarm, and without any warning to the work zone personnel.

Additionally, airborne particulate matter, birds, precipitation, and drifting debris can sporadically interrupt the constant signal or beam transmitted by the detector, thereby causing false detections, which results in a loss of credibility for the device and costly work stoppages. Further still, the distance between the detector and the siren necessitates a wireless data link therebetween (which itself require FCC approval).

Secondly, because a continuous wave infrared signal is employed, filters cannot be used in the receiver to remove low frequency infrared noise without also removing the infrared signal to be detected. Nor can filters be used in the receiver electronics to remove electromagnetic noise emanating from sources within or proximate to the work zone. The range of the device is therefore unduly limited, as the detector can not be placed more than 230 m. from the infrared source and still reliably distinguish the continuous infrared signal from other infrared energy present in the work zone. Given that typical roadway work zones have a length well in excess of 230 m., an unacceptably large number of infrared sources and detectors has to be used in order to detect breaching vehicles along the entire perimeter of the work zone adjacent to active traffic lanes. Moreover, because the infrared source has to transmit a focussed and narrow beam in order to have a detectable range of 230 m., the infrared detector has to be precisely positioned in the line of sight of the infrared source to receive the transmitted beam. The infrared detector is therefore difficult to set up and align along the work zone perimeter, and is not amenable to being moved frequently from work zone to work zone. This lack of portability is further amplified where numerous infrared sources and detectors have to be employed. The infrared detector can also be fooled into detecting a stray infrared signal as the constant infrared beam so that a vehicle can pass into the work zone undetected. Further still, this device, like all other prior art devices, employs an audible alarm for signalling personnel of an errant vehicle.

In addition, currently, systems used in controlling traffic conditions around work zones and incidents on the road are limited to the use of conventional static signs, flashing arrow signs, portable variable message signs (VMS) which are programmed with a single repeating message, or no signs at all. These systems provided little or no information which is useful to drivers, either for avoiding the development of a traffic jam or for finding alternative routes. Though portions of the highways close to large metropolitan areas are often equipped with permanently installed VMSs and traffic signal lights designed to control the in-flow or out-flow of traffic in the highways, there are large stretches of highways that lack any facilities for controlling the flow of traffic on the highway that are usable around work zones or incidents on the road. Rather, the same conventional equipment as described above is used and provides the same limited information to drivers. Even if permanently installed VMSs were available, current methods in the use of such devices also provide very limited information for drivers in avoiding traffic jams due to the presence of work areas and/or roadside incidents. Such information is not credible because the messages they convey is typically not appropriate to existing conditions.

Further examples of prior art traffic advisory and monitoring systems include U.S. Pat. No. 6,064,318, issued Jan. 16, 2000 to Kirchner III, et al. Kirchner discloses a portable traffic advisory system that monitors current traffic conditions in the vicinity of a construction zone or accident. This system is mainly intended to provide real time traffic information to motorists. Thus, this patent is directed to a portable system for automatic data acquisition and processing of traffic information in real-time. The system incorporates a plurality of sensors which are operatively positioned upstream of a work zone or roadway incident with each of the sensors being adapted to detect current traffic conditions. At least one variable message device is positioned upstream of the work zone or roadway incident. A plurality of remote station controllers are provided, each being operatively connected to the plurality of sensors and to the variable message device. A central system controller is located within remote communication range of the remote station controllers. The central system controller and the plurality of remote station controllers are capable of remotely communicating with one another. Each of the sensors is adapted to output traffic condition data to its corresponding remote station controller. The corresponding remote station controllers then transmits the traffic condition data to the central system controller. The central system controller automatically generates traffic advisory data based on the traffic condition data and transmits the traffic advisory data to the remote station controller that is connected to the variable message device. The traffic advisory data can also be used to communicate with and control highway advisory radio transmitters and ramp metering stations. One or more variable message devices, highway advisory radio transmitters and ramp metering stations are used to inform passing motorists of traffic conditions in and around a work zone or roadway incident, and thereby to control and improve the safety and efficiency of traffic operations around such sites. This traffic advisory data is limited to providing advisory information such as "Reduce Speed Ahead", and cannot provide legally enforceable speed limit changes.

U.S. Pat. No. 5,729,214, issued Mar. 17, 1998 to Moore, discloses a traffic signalling system that consists of roadside sensors for detecting traffic conditions, weather conditions, etc., a central processing station to which the detected conditions are transmitted and processed, and signals controlled by the central processing station in response to the detected conditions. This system permits dynamic monitoring of traffic conditions, and selective display of messages to motorists depending on the conditions. This is a particularly complex system employing satellite communication of the detected conditions to a remote central processing stations.

U.S. Pat. No. 5,673,039, issued Sep. 30, 1997 to Pietzch et al, discloses a traffic and road condition monitoring system that can be disposed along a roadway. The system includes multiple traffic and/or load-sensing sensors arrayed along the road to detect vehicle speed, traffic conditions, traffic violations, lane occupancy, etc. The processed output from the sensors controls a series of flashing lights and/or alpha-numeric displays in accordance with the detected conditions. The patent thus provides an arrangement for monitoring vehicular traffic and providing information and warnings to drivers of traffic disruptions, driver error, dangerous road conditions, and severe weather.

U.S. Pat. No. 5,610,599, issued Mar. 11, 1997 to Nomura, discloses a traffic signal control system for use in bi-directional flow control around a construction zone. The system consists of traffic lights at either end of the construction zone attached to a central controller. Sensors, e.g., pressure sensitive strips, are located at both ends of the construction zone and are attached to the controller. Each light is programmed with a minimum and maximum green light time. The light is initially activated for the minimum time. If heavy traffic is detected, the green light is extended for further incremental periods until the maximum time is reached.

U.S. Pat. No. 5,542,203, issued Aug. 6, 1996 to Luoma, provides a mobile sign with a solar panel for warning motorists of highway problems. The mobile sign comprises a wheeled vehicle, an electrically powered sign panel mounted on the wheeled vehicle, a chargeable battery for powering the sign panel, and a solar panel for charging the battery. The solar panel is rotatable and tiltable relative to the wheeled vehicle. The sign panel is independently rotatable relative to the wheeled vehicle.

U.S. Pat. No. 5,257,020, issued Oct. 26, 1993, to Morse, provides a moveable traffic signalling, which includes a trailer having wheels and a supporting structure. A general purpose message board is supported by the supporting structure of the trailer, for communicating to drivers of passing vehicles a user-selected alpha-numeric message. An operator interface is mounted on the supporting structure, for programming the message to be displayed at the site. A controller interacts with the operator interface to provide the programmed message to the message board.

U.S. Pat. No. 4,857,921, issued Aug. 15, 1988, to McBride et al, provides a digital control system for controlling the flow of traffic in selected directions in response to digital signals that are transmitted from a common transmitting control unit to multiple separate receiving traffic control units respectively associated with each controlled direction. The transmitting unit includes a transmitter and digital command code generator operative, when actuated, to transmit a character in the form of a digital signal specific for one of the receiving units. Each receiving unit includes traffic control indicators which are operative in different modes to display indications visible to traffic flowing in the direction to be controlled by that unit. Each receiving unit further includes a receiver operator to deliver demodulated characters based on codes which are transmitted by the transmitting unit. The codes control a microprocessor which is programmed to process the received characters to initiate command outputs. Logic circuitry is connected to receive the outputs. Responsive thereto, traffic control indications are displayed as determined by the local units demodulated characters. Each keeps a model of that which is displayed by other units in the system, and uses it to prevent conflicting traffic control indications.

None of the above systems provide a simple, reliable, traffic control system that monitors and controls vehicle speed through a work zone, or around an accident. It is, therefore, desirable to provide a variable work zone speed controller and system that can collect information related to vehicle speeds and traffic density in the work zone, and signal drivers appropriately.

SUMMARY OF THE INVENTION

It is an object of the present invention to obviate or mitigate at least one disadvantage of previous traffic regulation systems and controllers. It is particularly desirable to provide a system for traffic control that assures smooth flow through and around a road section under construction; improves safety of traffic flowing through and around a road section under construction; provides useful information to travellers in vehicles flowing through and around a road section under construction; automatically determines appropriate speed limits at various locations within a road section under construction; displays the current speed; provides relevant speed limits for existing traffic and site conditions within a road section under construction; enables smooth deceleration from highway speeds within a road section under construction; and enables uniform traffic speed within a road section under construction.

In a first aspect of the present invention, there is provided a variable speed limit controller. The variable speed limit controller is for communicating with a traffic station to determine a speed limit based upon input provided by a sensor in the station, and with a display for displaying a variable speed limit. The controller comprises an input, an output and a processor. The input is for receiving information related to lane occupancy and at least one of traffic flow, road conditions, vehicle speed, vehicle presence and weather conditions, from the sensor. The output is for transmitting a derived speed limit to the display. The processor is for receiving the information from the input, for determining the derived speed limit for a region adjacent to the station, based on the received information, and for providing the derived speed limit to the output for transmission to the display.

In an embodiment of the first aspect of the present invention the processor includes means for inversely varying the speed limit in accordance with lane occupancy information. In another embodiment of the present invention the input includes means for receiving information from a plurality of sensors located in a plurality of stations spaced apart from each other, the processor optionally includes means for deriving a speed limit for each station, based on the information received from the sensors located in each station, and the output optionally includes means for transmitting the plurality of derived speed limits to a corresponding plurality of displays. In a further embodiment of the first aspect the output includes means for transmitting the derived speed limit to the display using a wireless communications channel. In a presently preferred embodiment, the wireless communications channel is an RF communications channel.

In another embodiment of the first aspect of the present invention the processor includes means to derive a text based message, for transmission to the display by the output, the message derived using the information received from the input. In a further embodiment, the display includes means for displaying the derived text based message in addition to the derived speed limit. In another embodiment, the output includes a wireless modem to transmit output signals to a monitoring station, where the monitoring station can be selected from a list including a personal computer and a pager. In a presently preferred embodiment, the wireless modem is a cellular communication modem.

In a further embodiment of the present invention, the sensor is selected from a list including active radar sensors, passive acoustic sensors, ultrasonic sensors, pneumatic road hoses, tape switches, piezoelectric sensors, fibre optic sensors, quartz sensors, active magnetic devices, inductive loops, elongated elastomeric members having an elongated pressure sensor thereon, coaxial piezoelectric cables, flanged tube sensors with piezoelectric plates, and DYNAX™ sensors.

In another embodiment of the present invention, the variable speed limit system controller includes means for connecting a power supply to provide power to the input, the output, and the processor. In a further embodiment, the power supply includes a solar panel array. In other embodiments of the present invention, the processor includes means for determining the speed limit using a lookup table and the received information, and means for determining the speed limit using a lookup table, the received information, and time of day information.

In yet another embodiment of the present invention, the variable speed limit system controller includes a refresh engine for initiating a refresh of the derived speed by the processor, which optionally includes means for initiating the refresh at fixed intervals. Alternatively, the refresh engine can include means for initiating the refresh at intervals determined by the received information. In other embodiments of the present invention, the processor includes means for manually overriding the derived speed limit, and for providing a static speed limit and text message to the display.

In a further embodiment of the present invention, the variable speed limit system controller includes a self diagnosis engine for verifying that the operation of the input, the output and the processor are within predefined tolerances. In a further embodiment, the self diagnosis engine further includes means for entering a fail safe mode of operation when a component outside of the predefined tolerance is detected. In another embodiment of the present invention, the received information related to road conditions includes information regarding whether the road surface is dry, wet, icy or frost covered.

In another embodiment of the present invention the processor includes means for deriving general advisory messages based on the received information and for providing the derived general advisory messages to the output for transmission to the display.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

The present invention provides a variable speed limit (VSL) work zone safety system controller, which is designed to safely manage traffic speed approaching, and in, a construction work zone, and communicate related traffic information to motorists. The controller and system can also be used in other applications, such as special events, reduced speed areas, or restricted sections of roadway. The VSL controller determines a realistic dynamic speed limit for vehicles approaching, and in, the construction work zone, that is based on actual site conditions. The posted speed limit changes are based on lane occupancy, vehicle speed, average speed of a series of vehicles, work zone characteristics, road conditions and user configured parameters, e.g., maximum speed increment, maximum time before speed increment, maximum and minimum speed. The controller decreases the speed limit posted by the system before, or in, the construction zone. The system can decrease the posted speed limit as lane occupancy increases and/or travel speeds decrease, slowing traffic down, and improving safety conditions in the work zone. Other factors that can cause a lowering of the derived speed limit include road surface conditions and construction activity. As will be further described hereinafter, the VSL system includes systems to gather information about traffic and pavement conditions, a controller to analyse sensor information and to derive an optimum speed limit at several locations, a communication subsystem, and a message board to communicate the optimum speed to motorists.

The VSL system is generally installed in the area of a construction zone and in the approach to the construction zone, extending to a point beyond where the expected maximum queue will form. The system consists of traffic monitoring and signing stations which are installed at various positions in the construction zone, i.e., at the start and end of the construction zone, and at intervals for workzone speed control. The interval of stations also takes into account the presence of interchanges and other significant changes that could affect traffic flow. A station is ideally located downstream of every roadway entrance to ensure that all vehicles entering the traffic stream are made aware of the correct speed limit.

Figure 1:
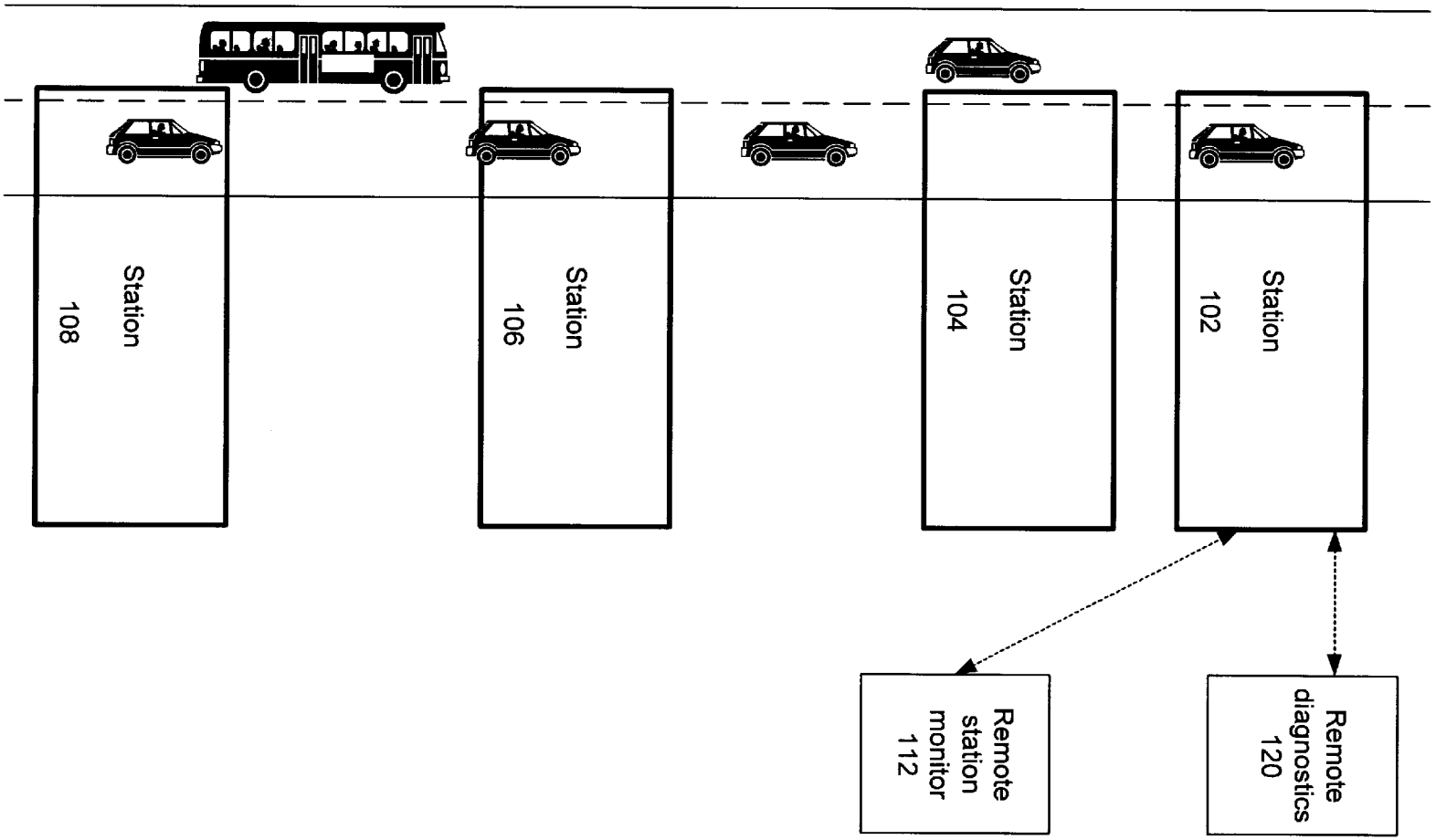
FIG. 1 is a schematic representation of an architecture employed by one embodiment of the present invention.

As seen in FIG. 1, the system architecture of the VSL System 100 includes a plurality of stations, which are preferably mounted on trailers for ease of mobility. In the illustrated embodiment, the system includes a downstream station 102, a first middle station 104, a second middle station 106, and an upstream system station 108. As will be understood by one of skill in the art, the number and disposition of stations is variable, and depends on many factors such as the length of the monitored zone, visibility impairments, cost and other standard factors. The downstream station 102 downloads set-up information, and operating parameters, described hereinafter, from a remote system monitoring unit 112. Finally, diagnostic update data communicating from downstream station 102 to remote system diagnostics display unit 120. Based on received data, station 102 derives a variable speed limit to display to the drivers of vehicles. Both remote system monitoring unit 112 and remote system diagnostics display unit 120 can be optionally integrated with station 102.

Messages are communicated between any one of downstream station 102, first middle station 104, second middle station 106, and upstream station 108. Communication between these stations can be implemented using a number of techniques known to one of skill in the art, including but not limited to direct-node-to-node communication, nearest neighbour relay, and hubbed communication. Various methods of data collision avoidance, detection, and recovery, including distinct channel use, token-based transmissions, and exponential back-off algorithms may also be implemented to enhance the operation of the system.

Figure 2:
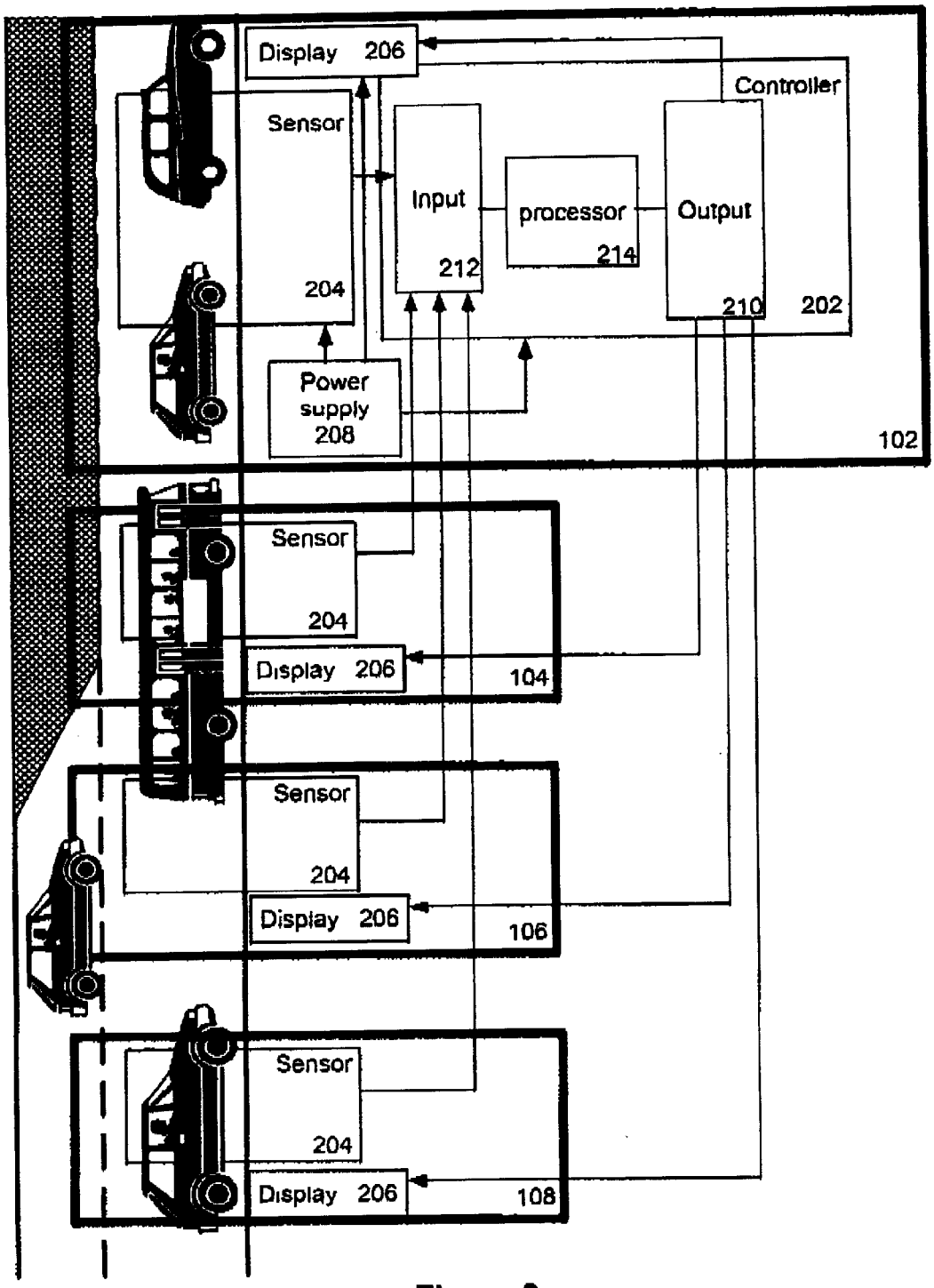
FIG. 2 illustrates the system architecture of a variable speed limit system of the present invention.
Figure 3:
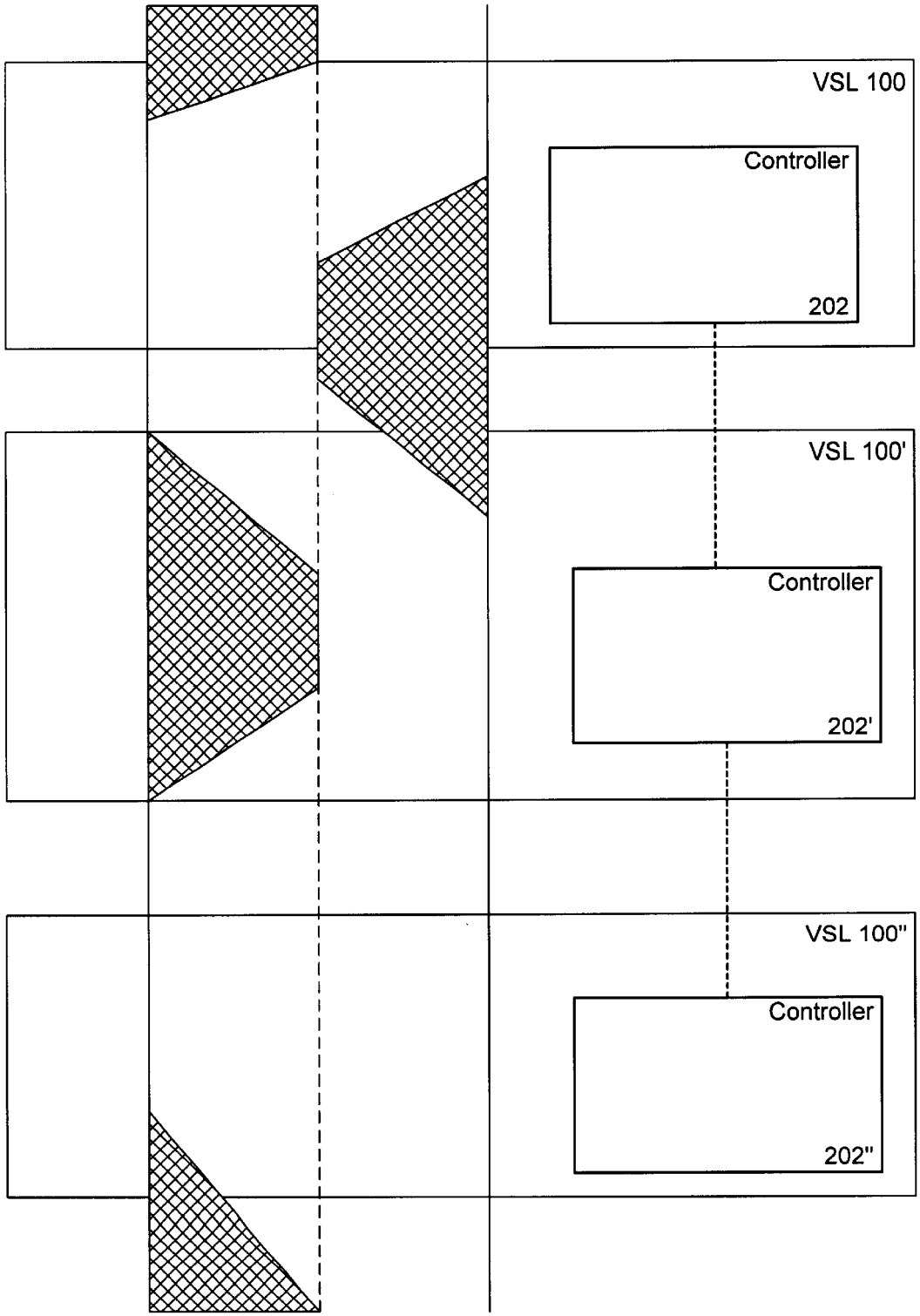
FIG. 3 illustrates the interaction between a plurality of variable speed limit systems according to the present invention.

In one embodiment, a controller is integrated into at least one of stations 102, 104, 106, and 108. If only one station has a controller, or if only one station has activated its controller, the other stations operate in a slave mode, where they are controlled by the master station Alternatively, each station can have an active controller, in which case the stations share data in a peer-to-peer communications model. FIG. 2 illustrates an embodiment in which station 102 includes controller 202, and has the remote system monitoring unit and the remote system diagnostics display integrated within it. In this embodiment, slave stations 104, 106 and 108 rely upon the master station 102 for diagnostics and speed monitoring. Controller 202 interfaces with slave stations 104, 206, and 108 to receive input from their sensors, and to derive a speed limit to display on their internal displays. Vehicles travelling on a roadway having an obstruction, such as a lane reduction, in this example, must pass stations 108, 106, 104, and 102. Each station has at least one sensor 204 which communicates with controller 202 integrated in station 102. Sensors 204 provide controller 202 with an indication of the traffic flow and/or mad conditions, in addition to lane occupancy information. Controller 202 using the information provided from sensors 204 in stations 102, 104, 106 and 108 derives speed limits for each of these stations to display. These derived speed limits are provided to displays 206 integrated within each station. The controller 202 comprises an input 212, an output 210 and a processor 214. The input 212 is for receiving information related to lane occupancy and at least one of traffic flow, road conditions, vehicle speed, vehicle presence and weather conditions, from the sensor. The output 210 is for transmitting a derived speed limit to the display 206. The processor 214 is for receiving the information from the input 212, for determining the derived speed limit for a region adjacent to the station, based on the received information, an for providing the derived speed limit to the output 210 for transmission to the display 206.

In preferred embodiments of the present invention, sensors 204 provide controller 202 with information related to lane occupancy in addition to at least one of: traffic flow; road conditions; vehicle speed; vehicle presence; and weather conditions. Sensors providing information on road conditions provide information related to the dryness of the road surface, and whether the road surface is icy, or frost covered. Relayed occupancy information is used by controller 202 to determine the variable speed limit. Controller 202 typically varies the variable speed limit inversely with the lane occupancy information, resulting in a lower speed limit when the lane occupancy increases. Controller 202 uses the information provided by sensors 204 in stations 102, 104, 106 and 108 to determine how the traffic is flowing between the various stations, thus the speed limit derived for each station can be different than the others. The varying of speed limits can be used to improve traffic flow by avoiding conditions that would cause sudden changes in the speed limit. Thus speed limits can be gradually reduced, so that sudden braking is not required at the point of a road obstruction. Following the obstruction, the speed limits can be increased so that traffic flows more smoothly. The manner in which controller 202 uses the input from sensors 204 to derive the variable speed limit can be defined in a series of profiles, one which is designated as the active profile. The active profile can be changed to take into consideration time of day, day of the week, or other factors that would affect the manner in which the input from sensors 204 should be interpreted. In a presently preferred embodiment of the controller, the controller receives input from sensors 204 and provides output to displays 206 using radio frequency (RF) communication links. These communication links can include cellular modem communication channels. In another embodiment, displays 206 are capable of displaying information to assist drivers in determining a desired course of action. For example, in addition to providing a speed limit, drivers can be advised that road conditions ahead have been impaired due to ice or rain.

Sensors 204 can typically be divided into two categories: intrusive and non-intrusive. Non-intrusive sensors include, but are not limited to, active radar sensors, passive acoustic sensors, ultrasonic sensors and optical sensing devices. Intrusive sensors include pneumatic road hoses, tape switches, piezoelectric sensors, quartz sensors, inductive loops, and elongated elastomeric members having elongated pressure sensors thereon. Additionally, active magnetic devices, coaxial piezoelectric cables, flange tube sensors with piezoelectric plates, and DYNAX™ sensors can also be used.

As additionally shown in FIG. 2, power supply 208 can be integrated within station 102. Power supply 208 is used to provide a constant power to controller 202, sensor 204, and display 206. Each station 102, 104, 106, and 108 have independent power supplies. Each station's power supply, provides power to the attached sensors and display units. In the event that the power supply in one of the stations fails, the stations will be unable to communicate with the other stations. Master station 102 will be able to determine that another station has failed because it will no longer be receiving sensor information from it. Various fail safe techniques, described hereinafter, can be employed so that a power failure in one of the stations will not result in a failure of the entire Variable Speed Limit System 100. If power supply 208 in station 102 fails, the master station will go off-line. Slave stations 104, 106 and 108 will be able to determine that there is no longer a master station as they will not receive output data for their displays. In one embodiment, another station will be designated as a fall-back master station, so that if master station 102 fails, another station will become the master station. This allows Variable Speed Limit System 100 to continue operating using the controller of the fall back master station. In a presently preferred embodiment, each station can monitor is battery level, and generate a low battery warning signal prior to total loss of power. This signal can be used to alert the user of the system that a particular station needs more power to prevent it from shutting down. If no action is taken to provide a new power supply to a station, an orderly shutdown can be affected so that the other stations will be aware that the low power station is going off line.

In many cases, road repairs are done over a wide area, where lane restrictions are alternately made to each of two lanes in a single direction. As a result, the merging of traffic must also coincide with forcing traffic to weave between areas of construction. As the construction zone increases in area, it may no longer be feasible to implement a single variable speed limit system 100 for the entire construction zone. In this case, distinct variable speed limits systems 100, 100', and 100" can be created. Each Variable Speed Limit System has a controller 202, 202', 202" respectively. These three controllers are responsible for controlling the various speed limits in each sector based upon the input from the sensors in their respective variable speed limit areas. The RF or cellular communication abilities of controller 202 allow the controller of each system to communicate with the other controllers. Communication between the three systems can allow for global traffic conditioning, so that the end of one variable speed limit system does not increase the speed of traffic, simply so that it may be slowed down again at the start of the next variable speed limit area. This segmentation of a construction zone allows for a simpler implementation of Variable Speed Limit System 100, and reduces the computational complexity required to administer a variable speed limit over a large area, with varying road conditions.

In a presently preferred embodiment, each slave station consists of the following major components, namely a trailer with display sign, a vehicle detection sensor, a controller, and RF communication and operating software. In addition, a master station includes all the components of the slave station, as well as a cellular modem and a highway condition monitor/sensor attached. Each such multiple monitoring and display slave stations and master station is independently powered and controlled.

Each station preferably consists of the following equipment: (1) Traffic detection unit: radar based non-intrusive data collection unit. (2) Power supply: solar panel with battery cabinet, a deep cycle power source (i.e., battery), and an emergency A/C power outlet to charge the power source to provide a temporary power source to the VSL station electronics. (3) Controller: processing unit for analysing inputs, for controlling communication and sign activation and also a RF communication module transmit data to other VSL Stations via radio frequency (RF) transmission. (4) Sign display: includes static and variable message portions, to display a two digit maximum speed. The station equipment is supplied and mounted on a trailer for portability and easy deployment.

In one embodiment, each VSL station is configured to communicate with adjacent stations via short range RF communication, to communicate with other telephony devices, e.g., a pager or remote computer via a cellular network, to communicate to other message signs to display general or specific traffic condition messages, and to connect to a local portable computer for diagnostics and configuration purposes. It will be well understood by one skilled in the art that other wireless communication channels can be employed without departing from the scope of the present invention.

The road surface detection sensor is configured to determine if the road surface is dry, wet, icy and if there is snow or frost on the pavement, and to be able to interface to the controller. It is preferably self-contained and is housed in its own NEMA enclosure, which is capable of sustaining the harsh environment of a construction zone. The master station is also equipped with a cellular modem, which is capable of connecting to a cellular telephone system. The modem is configured to interface to the controller. The modem is preferably configured to transmit and receive data at 9600 bits-per-second (bps) minimum. Each station includes a vehicle detection sensor, preferably a non-intrusive vehicle detection sensor. Such vehicle detection sensor is capable of detecting vehicle presence and is capable of determining vehicle speed. It is configured to interface directly to the controller. Each station measures traffic speed, occupancy and volume. Based on these values and the operating parameters, a recommended speed to be displayed will be determined for each sign. The recommended speed can be determined by one master control unit, or by each individual station based on input from adjacent stations. For each sign, the displayed speed is based on the downstream traffic characteristics, among other operating parameters, and the settings of the adjacent signs to ensure co-ordination between the signs.

The upstream station receives and implements the recommended speed, provided that the maximum speed differential between signs is not exceeded. The system is programmed to assure that the maximum, minimum, and increment parameters are not exceeded.

To ensure that these guidelines are followed, a system of two way communication is established between each set of adjacent stations. Each time that a change in display speed is recommended or implemented, this change is communicated between adjacent stations. An approval and confirmation process is implemented between stations to ensure that unwanted variations in the speed limit can not occur.

The VSL system according to the present invention has two modes of operation, namely Normal Mode, and Failure Recovery Mode. The Normal Mode has three categories of capabilities, namely VSL Operations; Data Collection Capability; and Diagnostics Capability.

Normal Mode VSL Operations: In the VSL operations mode, each station measures traffic speed, traffic occupancy, and traffic volume, and, based on these values and the operating parameters, determines a recommended speed limit to be displayed on the message sign on the upstream station. The VSL is configured to provide maximum flexibility in the setup and operation of the system by means of configuring parameters into the system. The software that is downloaded into the controller allows the system to be adapted to specific site conditions and allows the effectiveness of the system to be tested under various settings to determine the optimum operation and to establish guidelines for its use. Speed enforcement officers can use the posted speed limit at a station for speed limit enforcement purposes. Each time that a change in display speed is implemented, the system communicates the new speed limit at that station to a predetermined police officer pager. This police officer option has the capability of being enabled or disabled.

Normal Mode Data Collection Capability: This capability can be enabled or disabled by the user. This mode runs in parallel with any and all other modes of operation without inhibiting the operation of the other modes. In a present embodiment Data is collected for the lane that is closest to the trailer, and this is the only information that is used in the determination of speed limits. Traffic data is recorded at each station and includes volume, lane occupancy, average speed, and simple length classification at five minute time intervals. Data is preferably stored from each station for a minimum of 7 days, and can be downloaded manually on-site or remotely via a standard PC computer running any terminal program. The system also logs each change in display speed that is implemented including the time that the change was made. The log file is "read only" file. It will be well understood by one skilled in the art that in alternate embodiments the information from other lanes, or from a plurality of lanes can be collected and used in the speed limit determination process.

Normal Mode Diagnostics Capability: The diagnostics capability provides self-diagnostics capabilities and user diagnostic capabilities. The self-diagnostic capabilities are automated and do not require any user initiation or intervention to execute. The user diagnostic capabilities are defined as user initiated and/or require user intervention to execute. The self-diagnostics is performed at a system level and at a station level. Each station performs self-diagnostics. It performs traffic sensor status to verify that the sensor is transmitting data to the controller. It performs message sign controller status to verify that the controller has communication with the message sign controller. It performs RF modem status to verify that the controller has communication with the RF modem. It performs power source capability to verify that the battery power availability is greater than 10% of maximum capacity. The master station has added self diagnostic capabilities, namely, the capability to perform road condition sensor status to verify that a signal is being received from the sensor, and to perform cellular modem status to verify that the controller has communication with the cellular modem. The master station analyses the data which is communicated between stations and, depending on the information in the data, determines if the system is in normal mode or a failure mode. The system reverts to failure mode if the master station determines that one or more of the stations fails a self diagnostics test.

The diagnostics system is configured to perform diagnostics at a station level and at a system level.

Diagnostics System Station Level: The system is configured to be capable of diagnosing traffic sensor performance to enable a local user to verify that the traffic sensor is collecting data in accordance with the specifications of the sensor manufacture. The station level diagnostic system is capable of diagnosing RF communication performance to enable a local user to verify that the RF or cellular modems are performing in accordance their defined specifications. It is capable of diagnosing message sign performance to enable a local user to verify that the message sign is performing as in accordance with its specifications.

Diagnostics System System Level: The system is configured to enable a local user to determine which if any, of the stations are performing abnormally. The system need not necessarily determine what the problem is at that particular station, instead mere detection of the problem will typically suffice.

The VSL system enters a fail safe mode if a self diagnostics fault is detected and there is no degraded mode of operation. The system is configured to have two degrees of failure if a self diagnostics failure is detected; namely, degraded status and severe status.

Failure Mode Degraded Status: Degraded status is operationally less severe than a severe failure status. If a station reverts to degraded status it does not impair an upstream or downstream station from operating in normal mode. Degraded status is configured to provide RTMS self diagnostics failure wherein the station with the failure uses the RTMS measurements from the station most likely to have worse traffic conditions. It provides message sign self-diagnostics failure wherein the station with the failure does not display any message but still communicates what the posted message would have been to the next appropriate station. It provides road surface condition detection sensor self diagnostics failure wherein the station with the failure assumes that the road condition is wet. It provides power system self diagnostics failure where the system attempts to continue operating until power has been depleted from the station. Any station failure that is not described in degraded status above or any unexpected loss of RF communication with one other station is cause for reverting to severe failure status. If any station reverts to a degraded status, the affected station attempts to display the appropriate speed limit and attempts to communicate the error and the station status to the master station. The station attempts to transmit the error and station status to the master station. If the master station determines that one or more stations can be operating in failure mode, it logs the event and transmits a message to a maintenance pager via cellular network. The user also has the option to have the message transmitted to a PC computer.

Failure Mode Self Recovery: Self recovery is an automated process that uses the controller to attempt to re-establish proper operation of the device or station that has experienced a self diagnostics failure. The method of self recovery is device dependent. The station or system continues to attempt self recovery until the failure has been rectified. If self recovery is successful, the system logs the event and reverts to normal mode. Preferably, the VSL system is configured to include: cell modem access to download data files, the addition of a moisture detection sensor or other external sensor that will affect the settings of the system; processor automated switching of settings files based on pre-set time of day parameters, external triggers (e.g., weather system), or remote access via cell modem; a test pager to allow call out with operating status of system at regular intervals and notification of failure conditions; and the addition of VMS at the most upstream location that could be programmed to display messages such as "Reduced Speed Limit Ahead" or "1 Hour Delay Ahead" when certain conditions exist.

Manual Operation Capability: In this mode, the message display is static. The message displayed is configured by the user. The message is a non-dynamic speed limit posted on the message sign or can be blank, whichever the user defines. All stations in a system displays the same speed while in manual mode, or different speeds as set for each station. The system continues to process and perform all other functions that are unrelated to the display. The system has a manual override at the master station to switch from manual control to automatic control such that the system can display the user-defined speed without having to access the system software.

The controller 202 is preferably capable of operating in an ambient temperature range of from −10 to +45° C. to allow use in a variety of climates. Controller 202 preferably allows a remote computer to configure its user configurable parameters to define both normal and failure modes. These parameters are typically downloaded by controller 202 from an external data source. They enable controller 202 to provide the two previously described modes of operation, namely Normal Mode and Failure Recovery Mode.

In a presently preferred embodiment, the downloaded parameters that define operation in the Normal Mode provide three categories of capabilities, namely VSL Operations; Data Collection; and Diagnostics. The downloaded parameters for the VSL operations enable each station to measure conditions such as speed, occupancy, volume and other traffic indicators. Based on these measured values and the operating parameters, different configurations. Multiple configuration files provide a simplified method of changing operating parameters based on site conditions or testing requirements. Among the parameters which can be downloaded into controller 202 are smoothing and hysteresis logic to prevent the displayed limit from oscillating when the derived speed is near the rounding point between two adjacent speed limits. The downloaded software can use different speed factors (parameters) for daytime, night-time, and non-construction time periods. The downloaded parameters automatically adjust the displayed speed limit based on the road conditions the road condition sensor output. The software preferably has user defined road factors for icy, snowy, wet and dry conditions. The road factor is preferably a simple lane occupancy multiplier such that, as road conditions deteriorate, effective lane occupancy increases resulting in a slower posted speed limit. The road surface conditions at the road sensor are deemed to be the road conditions at all points until the next road sensor.

The system initiates a call once per day, or at another user specified interval, either to a pager or to a computer running a terminal program to indicate that the system is operational and that no failures have occurred. The controller 202 is also capable of being operated manually as previously described. The parameters to enable such manual operation include enabling the message display to be static. In manual mode, the message is a static speed limit posted on the message sign, or the display can be blank, whichever state is defined by the user. It is preferred that all stations in VSL 100 display the same speed while in manual mode, though different stations can be configured to show different speeds. In manual mode, the system can continue to process and perform other functions unrelated to the display.

The controller 202 can also download an application program to provide the above-described Data Collection Capability. Preferably, the Data Collection Capability can be enabled or disabled by the user. This mode can run in parallel with any and all other modes of operation without inhibiting the operation of the other modes.

While in operation, the VSL system 100 can also record data related to traffic and system operation. Data is typically collected for the lane that is closest to the station. It is believed that traffic in adjacent lanes will self regulate the speed, so that the data collected for the single lane is the only information used in the determination of speed limits. In an alternate embodiment, as described above, data can be collected for other lanes, or a plurality of lanes for more accurate traffic flow modelling. Traffic data is typically recorded at each station and can include volume, lane occupancy, average speed, and simple length classification at five-minute time intervals, for later analysis. Data from each station is preferably stored for a minimum of seven days, and can be downloaded manually by connecting to the station with a suitably configured and connected computer. Alternatively the data can be downloaded automatically, or through a wireless data connection such as an RF data link. The system can also log changes in display speed and the time that the change was made.

At regular intervals, a status check is typically initiated by the master station, and passed to each of the slave stations. The status check verifies that the communication is functioning between each of the stations. If a station does not receive a positive status for all stations within a configurable time period, it can be configured to automatically display the minimum work zone speed. The first station is equipped with a cellular modem and can initiate an emergency callout if there is a system failure. The system can log any loss of communication. Typically, these are logged in two classes, minor communication errors that simply required retransmission, and major communication errors where the default sign speed must be used.

There is a two-way communication between the controller 202 and other units. In one such configuration, each station is programmed to transmit data to other VSL Stations via radio frequency (RF) transmission. The communication between the stations of one system does not interfere with the Stations of other VSL systems. Preferably the maximum line of sight distance between stations is 3 miles (5 kms).

Examples of commercially available communication devices include Freewave spread spectrum communications devices, WIT spread spectrum transceivers available from Digital Wireless Corporation, Hoplink, available from ENCOM Radio Services Inc., 220 MHz frequency radio available from SEA, cellular modems and radio modems. controller 202 determines a recommended safe speed limit to be displayed on the message sign on the corresponding station.

The operating parameters downloaded into the controller 202 allow the system to be adapted to specific site conditions and to allow the effectiveness of the system to be tested under various settings to determine the optimum operation and to establish guidelines for its use. The variable speed limit display is based on traffic characteristics at, or downstream of, the sign. The displayed speed limit can respond quickly to changing conditions.

The operating parameters, downloaded into the controller 202, or configured by a user, control the function of the system. The controllable functionality includes: (1) Maximum speed: This is the highest speed that the system displays, it always is greater than or equal to the minimum speed. (2) Minimum speed: This is the lowest speed that the system displays, it is always lower than or equal to the maximum value. (3) Display speed: Display speed is determined for each sign from a table or algorithm that includes occupancy and average speed, as detected by the various sensors. This allows the user to determine what criteria are applied in the derivation of the displayed speed. The criteria can be selected to use only one variable, or a combination of variables, to determine an optimum speed to be displayed. (4) Update frequency: To avoid fluctuations in the displayed speed which may result in driver confusion, a minimum time between changes in displayed limits can be set. The average value for measured conditions over this period will be used to determine the update value. (5) Maximum speed increase increment: The displayed speed for each sign can be determined based on measurements at different locations throughout the system and with varying traffic conditions can fluctuate widely. This parameter allows for a smooth transition in speed zones by controlling the amount that the limit can be increased or decreased in a single adjustment. (6) Maximum speed differential: This parameter allows for a smooth transition in speed zones by controlling the maximum difference in speed displayed at two adjacent locations.

The configuration information is preferably stored in a setting file, and it is possible to store multiple files each of which can be selected to enable a plurality of The controller 202 is also in two-way communication with display 206. In a preferred embodiment, the display is a variable message sign (VMS) that is programmed to receive data from the controller 202 and to display the derived speed limit. In addition, the VMS can be programmed to display other messages, e.g., "Reduced Speed Limit Ahead" or "One-hour Delay Ahead" under certain conditions.

Examples of other commercially-available regulatory signboards include those available from NES-WorkSafe of Michigan, Michigan Road Dynamics and Mike Madrid Company of Indianapolis. However, it is standard practice that regulatory signboards with flashers are typically manufactured on a state-by-state, or province by province basis, by local companies, because each jurisdiction typically has slightly different standards. Other signs can be electronic message board signs which include VMS (Variable Message Signs) and CMS (Changeable Message Signs). Typical manufacturers include ADDCO of Minnesota, F-P Electronics of Mississauga, Ontario, Infocite of Montreal, Quebec, and FDS (Fibre Display Systems) of Rhode Island, Technologies include incandescent bulbs, flip-disk, LED, LCD, and fibre optic. Still other message signs are provided in the following patents: U.S. Pat. No. 5,900,826, issued to Farber, which relates to remote-controlled portable traffic signals. U.S. Pat. No. 5,729,214, issued to Moore, which is directed to a digitally-effectuated automatic control over a message which is displayed on a programmable display medium. U.S. Pat. No. 5,542,203, issued to Luoma et al, which is directed to a mobile sign with solar panel. U.S. Pat. No. 5,257,020, issued to Morse, which is directed to a variable message traffic signalling trailer.

The controller 202 receives data from sensors such as a vehicle presence detector and highway condition monitors. Such vehicle presence detection sensors are capable of detecting vehicle presence and speed.

Sensors can be non-intrusive or intrusive. An example of a non-intrusive sensor is a radar sensor known as a RTMS (Remote Traffic Microwave Sensor) manufactured by EIS of Mississauga, Ontario, the RTMS is a true RADAR (Radio Detection And Ranging) device. As such, it provides true presence detection of vehicles in multiple zones. Its ranging capability is achieved by Frequency Modulated Continuous Wave (FMCW) operation. In use, the sensor transmits a microwave beam and receives energy that is reflected by objects (vehicles and stationary objects) in its path. The nominal 10.525 Ghz frequency (or 24.20 Ghz for the K band model) is varied continuously in a 45 MHz band. At any given time there is a difference between the frequencies of transmitted and received target signals. The difference in frequencies is proportional to the distance between the RTMS and the target. The RTMS detects and measures that difference and computes range (distance) to the vehicles and/or stationary objects. FMCW sets the RTMS apart from other microwave sensors, which use the Doppler effect (frequency shift caused by motion) and can therefore detect only moving targets. The RTMS detects presence of objects in 2-m (7 ft.) wide radial range slices in the path of the microwave beam. The RTMS microwave beam is 40–45° in height and 15° in width. When pointed onto a roadway, it projects an oval footprint with up to 32 range slices. The width of the footprint depends on the selected mode and varies slightly with the mounting angle of the sensor and position along the oval footprint (i.e., distance from the sensor). The RTMS can be mounted on the side of the road (Side-Fired configuration) with the oval footprint at a right angle to the traffic lanes. The sliced footprint can provide up to 8 individual detection zones, corresponding to traffic lanes. Detection zones can be defined as one or more range slices. The width of the footprint determines the length of the detection zones. The RTMS can also be mounted in a Forward-Looking configuration with the detection zones aligned along the direction of travel. The RTMS is thus a radar based multi-lane detection from a single sensor. It enables volume, lane occupancy, speed and simple length classification with tabular interval data collection. It offers low life cycle costs, with simple setup and operation.

Other non-intrusive traffic sensors include ultrasonic pulse sensors, Doppler sensors, passive infrared devices, active infrared devices Doppler microwave devices, video devices which use a microprocessor to analyse the video image input from a video camera, and passive acoustic devices consisting of an array of microphones aimed at the traffic stream. Thus, all these non-intrusive detection devices are those devices that cause minimal disruption to normal traffic operations and can be deployed more safely than conventional detection methods. Based on this definition, non-intrusive devices are devices that do not need to be installed in, or on, the pavement but can be mounted overhead, to the side, or beneath the pavement by "pushing" the device in from the shoulder. They are commercially available from the sources set forth in the following table:

| TECHNOLOGY | VENDOR |
|---|---|
| Passive Infrared | Eltec Instruments, Inc. |
| Passive Infrared | ASIM Engineering LTD. |
| Passive Infrared | SANTA FE Technologies, Inc./Titan |
| Active Infrared | Schwartz Electro-Optics, Inc. |
| Active Infrared | Spectra Systems (Manufactured by MBB Business Development GmbH, Germany) |
| Radar | EIS (Electronic Integrated Systems) |
| Doppler Microwave | Microwave Sensors, Inc. |
| Doppler Microwave | Peek Traffic, Inc. |
| Doppler Microwave | Whelen Engineering Co. |
| Pulse Ultrasonic | Novax Industries Corp. |
| Pulse Ultrasonic | Microwave Sensors, Inc. |
| Pulse Ultrasonic | Sumitomo Electric USA, Inc. |
| Passive Acoustic | IRD (International Road Dynamics) |
| Passive Acoustic | SmarTek Systems, Inc. |
| Video | Eliop Trafico |
| Video | Image Sensing Systems |
| Video | Rockwell International |
| Video | Peek Traffic - Transyt Corporation |
| Video | Computer Recognition Systems, Inc. |
| Video | Sumitomo Electric USA, Inc. |
| Video | Automatic Signal/Eagle Signal |
| Video | Condition Monitoring Systems, Inc. |
| Video | Nestor, Inc., Intelligent Sensor Division |

When an intrusive traffic sensor is mounted on top of the roadway, it can be of the form of a pneumatic road hose, tape switches, piezoelectric sensors, fibre optic sensors, or quartz sensors. Pneumatic road hose is a portable rubber type of hose which is secured on top of the roadway. Tape switches are a relatively old technology. Fibre optic sensors are relatively new and one company that manufactures these is Optical Sensor Systems. Piezoelectric sensors are manufactured by Measurement Specialties Inc. of the U.S.A., Thermocoax of France, and Traffic 2000 of the U.K. Fibre optic sensors can also be installed in the roadway, either directly into a road cavity or into a frame encasement. Still other intrusive sensors include passive magnetic devices which measure the change in the earth's magnetic flux created when a vehicle passes through a detection zone, active magnetic devices, e.g., inductive loops, which apply a small electric current to a coil of wires and detect the change in inductance caused by the passage of a vehicle. When the traffic sensor is mounted adjacent the roadway, the traffic sensor can be a flexible carrier comprising an elongated flat elastomeric member having an elongated pressure sensor in a groove in one of its surfaces, as disclosed in U.S. Pat. No. 5,463,385 issued Oct. 31, 1995 to Tyburski; a coaxial piezoelectric cable having a conducting core, a conductive polymer surrounding the core, a conductive sheath therearound and an electrically non-conductive gasket around the coaxial cable, as taught in U.S. Pat. No. 5,477,217 issued Dec. 19, 1995 to Bergan; a flanged tube sensor with piezoelectric crystal plates, as taught in U.S. Pat. No. 5,461,924 patented Oct. 31, 1995 by Calderara et al.; a DYNAX™ sensor, which is a force sensing variable resistor embedded in a resilient, rubber-like strip that is moulded around the resistor within an elongated sheet metal channel, as disclosed in U.S. Pat. No. 4,799,381, patented Jan. 24, 1989 by Tromp (the DYNAX™ sensors can also be installed directly into a road cavity and held in place with epoxy, and not only installed in a metal channel); or a pressure-sensitive, light-conducting cables, as taught in U.S. Pat. No. 5,020,236, patented Jun. 4, 1991 by Kauer et al.

Other commercially available intrusive detection devices include the following:

| TECHNOLOGY | VENDOR |
|---|---|
| Magnetic | Safetran Traffic Systems, Inc. |
| Magnetic | 3M, Intelligent Transportation Systems |
| Magnetic | Nu-Metrics, Inc. |

Examples of commercially available interface controllers are those which are provided by the above suppliers for the non-intrusive sensor. Other generic interface controllers can include traffic counter and classifiers (PEEK, IRD, Diamond Traffic, ITC Golden River), Intersection Controllers (170 Controller) and SCADA devices.

Power is preferably provided by means of a solar panel power supply and a power storage device. One commercially-available solar panel is manufactured by Solarex. The solar power equipment and batteries can be of the types of batteries typically associated with solar power. The power storage device is typically a deep cycle power source (e.g., a battery) and an emergency A/C power outlet to charge the power source, or to provide a temporary power source to the VSL station electronics. In order to provide programmable capabilities to the VSL system 100, the controller 202 can preferably interfaced directly with an external data display/entry device, e.g., a laptop computer.

In an alternate embodiment of the present invention, the data from sensors 204 is used by controller 202 to generate general advisory messages for traffic conditions in addition to deriving the variable speed limit. These messages can be used to advise drivers to slow down, shift in a particular direction, or prepare to merge into another lane of traffic, among other general directions.

The above-described embodiments of the present invention are intended to be examples only. Alterations, modifications and variations can be effected to the particular embodiments by those of skill in the art without departing from the scope of the invention, which is defined solely by the claims appended hereto.

What is claimed is:

1. A variable speed limit system controller for communicating with a traffic station to determine a speed limit based upon input provided by a sensor in the station, and with a display for displaying a variable speed limit, the controller comprising:

an input for receiving information related to lane occupancy and at least one of traffic flow, road conditions, vehicle speed, vehicle presence and weather conditions, from the sensor;

an output for transmitting a derived speed limit to the display; and a processor for receiving the information from the input, for determining the derived speed limit for a region adjacent to the station, based on the received information, and for providing the derived speed limit to the output for transmission to the display.

2. The variable speed limit system controller of claim 1, wherein the processor includes means for inversely varying the speed limit in accordance with lane occupancy information.

3. The variable speed limit system controller of claim 1, wherein the input includes means for receiving information from a plurality of sensors located in a plurality of stations spaced apart from each other.

4. The variable speed limit system controller of claim 3, wherein the processor includes means for deriving a speed limit for each station, based on the information received from the sensors located in each station.

5. The variable speed limit system controller of claim 4, wherein the output includes means for transmitting the plurality of derived speed limits to a corresponding plurality of displays.

6. The variable speed limit system controller of claim 1, wherein the output includes means for transmitting the derived speed limit to the display using a wireless communications channel.

7. The variable speed limit system controller of claim 6, wherein the wireless communications channel is an RF communications channel.

8. The variable speed limit system controller of claim 1, wherein the processor includes means to derive a text based message, for transmission to the display by the output, the message derived using the information received from the input.

9. The variable speed limit system controller of claim 8, wherein the display includes means for displaying the derived text based message in addition to the derived speed limit.

10. The variable speed limit system controller of claim 1, wherein the output includes a wireless modem to transmit output signals to a monitoring station.

11. The variable speed limit system controller of claim 10, wherein the wireless modem is a cellular communications modem.

12. The variable speed limit system controller of claim 10, wherein the monitoring station is selected from a list including a personal computer and a pager.

13. The variable speed limit system controller of claim 1, wherein the sensor is selected from a list including active radar sensors, passive acoustic sensors, ultrasonic sensors, pneumatic road hoses, tape switches, piezoelectric sensors, fibre optic sensors, quartz sensors, active magnetic devices, inductive loops, elongated elastomeric members having an elongated pressure sensor thereon, coaxial piezoelectric cables, flanged tube sensors with piezoelectric plates, and DYNAX™ sensors.

14. The variable speed limit system controller of claim 1, further including means for connecting a power supply to provide power to the input, the output, and the processor.

15. The variable speed limit system controller of claim 14, wherein the power supply includes a solar panel array.

16. The variable speed limit system controller of claim 1, wherein the processor includes means for determining the speed limit using a lookup table and the received information.

17. The variable speed limit system controller of claim 1 wherein the processor includes means for determining the speed limit using a lookup table, the received information, and time of day information.

18. The variable speed limit system controller of claim 1, further including a refresh engine for initiating a refresh of the derived speed by the processor.

19. The variable speed limit system controller of claim 18, wherein the refresh engine includes means for initiating the refresh at fixed intervals.

20. The variable speed limit system controller of claim 18, wherein the refresh engine includes means for initiating the refresh at intervals determined by the received information.

21. The variable speed limit system controller of claim 1, wherein the processor includes means for manually overriding the derived speed limit, and for providing a static speed limit and text message to the display.

22. The variable speed limit system controller of claim 1, further including a self diagnosis engine for verifying that the operation of the input, the output and the processor are within predefined tolerances.

23. The variable speed limit system controller of claim 22, wherein the self diagnosis engine further includes means for entering a fail safe mode of operation when a component outside of the predefined tolerance is detected.

24. The variable speed limit system controller of claim 1, wherein the received information related to road conditions includes information regarding whether the road surface is dry, wet, icy or frost covered.

25. The variable speed limit system controller of claim 1, wherein the processor includes means for deriving general advisory messages based on the received information and for providing the derived general advisory messages to the output for transmission to the display.

* * * * *